US006165025A

United States Patent [19]

Meng

[11] Patent Number: 6,165,025

[45] Date of Patent: Dec. 26, 2000

[54] CARD EDGE CONNECTOR ASSEMBLY

[75] Inventor: Ching-Chang Meng, Tu-Cheng, Taiwan

[73] Assignee: Hon Hai Precision Ind. Co., Ltd., Taipei Hsien, Taiwan

[21] Appl. No.: 09/417,270

[22] Filed: Oct. 13, 1999

[30] Foreign Application Priority Data

Jul. 6, 1999 [TW] Taiwan ..... 87217996A01

[51] Int. Cl.[7] ..... H01R 13/64

[52] U.S. Cl. ..... 439/681; 439/488

[58] Field of Search ..... 439/681, 680, 439/488, 489

[56] References Cited

U.S. PATENT DOCUMENTS

| | | | |
|---|---|---|---|
| 3,576,519 | 4/1971 | Janye et al. | 439/681 |
| 3,634,816 | 1/1972 | Zell | 439/681 |
| 4,307,927 | 12/1981 | Mollman | 439/681 |
| 5,019,947 | 5/1991 | Pelzl | 439/681 |
| 5,387,132 | 2/1995 | Sarver et al. | 439/681 |
| 5,688,147 | 11/1997 | Coteus et al. | 439/681 |

*Primary Examiner*—Gary F. Paumen

*Attorney, Agent, or Firm*—Wei Te Chung

[57] ABSTRACT

A card edge connector assembly comprises an elongate housing mounted on a mother board, and a switch key for engaging with the housing and activating inner circuitry formed in the mother board. The housing comprises an elongate slot formed between opposite side walls thereof for receiving a daughter board, a plurality of receiving passageways defined in each side wall for retaining contacts therein, a pair of cutouts transversely defined in a mating face of the housing, and a projection transversely formed between the side walls. The daughter board defines a pair of notches corresponding to one of the cutouts and the projection of the card edge connector. The switch key can transmit information to the mother board by electrical contact between a conductive membrane disposed on the switch key and the corresponding contacts received in the passageways below the corresponding cutout of the housing. Thus, a daughter board having a certain operational voltage can be properly inserted into the slot of the card edge connector. The switch key may also transmit information to the mother board by separating an engagement between the contacts received in the passageways below the corresponding cutout of the housing.

3 Claims, 8 Drawing Sheets

CARD EDGE CONNECTOR ASSEMBLY

BACKGROUND OF THE INVENTION

The present invention relates to a card edge connector mounted on a circuit board, and particularly to a universal card edge connector which is adapt to meet different requirements of operational voltages and specifications so that facilitates robust mounting of connectors without modification and/or alternation.

Nowadays, an electronic instrument, such as a computer, is provided with increased functional capacities, while a mother board of the computer is designed to accommodate the increased number of functions. Therefore, supplementary mechanisms are incorporated to the motherboard to meet the demand. The supplementary mechanisms usually comprise a plurality of supplementary daughter boards inserted in corresponding elongate connectors, and corresponding circuitry formed on the mother board.

Two types of specifications are currently. One is the Industry Standard Architecture (ISA) spec, and the other is the Peripheral Component Interconnect (PCI) spec. The ISA spec provides an electrical interface for enlarging electrical circuitry capacities and has a low transmission speed. The PCI spec has gained more popular application than the ISA spec due to its faster transmission speed. According to practical requirements, daughter boards of the PCI spec commonly have two operational voltages of 3.3 v and 5 v. A 5 v daughter board can not normally function at an operational voltage of 3.3 v, while a supplementary 3.3 v daughter board will be damaged by a 5 v operational voltage. Thus, electrical connectors and a mother board of the PCI spec supplementary mechanism should be predesigned to prevent such problems. Referring to FIG. 7A, a PCI spec card edge connector 5 of 3.3 v and a mating daughter circuit board 6 are shown. The card edge connector 5 comprises an elongate slot 51 for receiving the daughter board 6, and a pair of projections 52, 53 formed within the slot 51. The daughter board 6 defines a pair of notches 61 on an edge thereof corresponding to the projections 52, 53 of the card edge connector 5. The projections 52, 53 are separated a first distance. When the daughter board 6 is inserted into the slot 51 of the card edge connector 5, the projections 52, 53 engage with the corresponding notches 61 thereby activating inner circuitry formed in a mother board (not shown) to distinguish that the daughter board has an operational voltage of 3.3 v.

Referring also to FIG. 7B, a 5 v PCI card edge connector 5' and a mating daughter board 6' are shown. The card edge connector 5' forms a pair of projections 52', 53' within an elongate slot 51'. The two projections 52', 53' are separated a second distance. The second distance is different from the first distance and is normally shorter than the first distance. Similarly, when the projections 52', 53' engage with corresponding notches 61'0 defined in an edge of the daughter board 6', inner circuitry formed in a mother board (not shown) is activated and the daughter board 6' is thus distinguished by the mother board 5' and provided with the necessary voltage.

However, if a mother board require both card edge connectors of 3.3 v and card edge connectors of 5 v, both the 3.3 v and 5 v card edge connectors should be provided together which is obviously inconvenient and cost inefficient. Therefore, a universal card edge connector is required for adapting to daughter boards having different operational voltage.

BRIEF SUMMARY OF THE INVENTION

A main object of the present invention is to provide a universal card edge connector assembly which can interconnect daughter boards having different operational voltages with a mother board.

Another object of the present invention is to provide a card edge connector assembly having a switch key that can be conveniently positioned and secured to the card edge connector assembly thereby activating different selected circuitry to provide correct operation voltage to an inserted daughter board.

In order to achieve the object set forth, a card edge connector assembly in accordance with the present invention comprises an elongate housing mounted on a mother board, and a switch key for activating a proper inner circuitry formed in the mother board. The housing defines an elongate slot between opposite side walls thereof for receiving a daughter board. A plurality of receiving passageways is defined in each side wall of the housing for retaining contacts therein. A pair of cutouts is transversely defined in a mating face of the housing for engaging with the switch key. A projection is transversely formed in the slot between the side walls for engaging with the daughter board. The daughter board defines a pair of notches in an edge thereof corresponding to one of the cutouts and the projection of the card edge connector.

According to an aspect of the present invention, each cutout has a width equal to or slightly larger than a width of each receiving passageway. A pair of sloped guiding surfaces is formed on opposite sides of the slot of the housing for guiding the switch key to smoothly engage with the corresponding cutout. The slot has a first width. The distance between top edges of the two sloped guiding surfaces is larger than the first width.

According to another aspect of the present invention, the switch key comprises a main frame, a pair of cantilevered arms downwardly extending from opposite ends of the main frame for engaging with the side walls of the housing, and an engaging body downwardly extending from the main frame between the cantilevered arms for insertion within the corresponding cutout.

Still according an aspect of the present invention, a second width of the engaging body of the switch key is slightly larger than the first width and slightly smaller than the distance of top edges of the sloped guiding surfaces. The cantilevered arms downwardly extend a length substantially equal to a length of the engaging body for abutting against outer surfaces of the opposite side walls of the housing. A pair of inclined guiding faces is formed on opposite outer edges of the engaging body of the switch key. Thus, when the engaging body of the switch key engages with the slot of the housing, the switch key is smoothly disposed into and remains within a space between the sloped guiding surfaces of the slot with the help of the cantilevered arms abutting against the side walls of the housing. The switch key can then smoothly slide within the slot until engaging with the corresponding cutouts by guidance of the inclined guiding faces of the engaging body and the sloped guiding surfaces of the slot.

The switch key of the card edge connector transmits information to the mother board to distinguish a daughter board having a certain operational voltage to be inserted into the slot of the card edge connector.

In a first preferable embodiment, a conductive membrane is provided to enclose a periphery of the engaging body of the switch key. When the switch key is driven to engage the corresponding cutout, the conductive membrane electrically engages contacts retained in the receiving passageways below the cutout. Thus, circuitry formed in the mother board is activated whereby the daughter board is accepted by the mother board and the proper operational voltage is provided.

In a second preferable embodiment, a pair of contacts positioned in the receiving passageways below the corresponding cutout has contacting sections electrically contacting each other. When the switch key is inserted into the cutout, the engaging body separates the contacts. Thus, the mother board receives information to distinguish daughter boards having different operational voltages, since the switch key can be selectively inserted into the corresponding cutout according to practical requirements of the daughter boards.

Other objects, advantages and novel features of the invention will become more apparent from the following detailed description when taken in conjunction with the accompanying drawings.

DETAILED DESCRIPTION OF THE INVENTION

Figure 1:
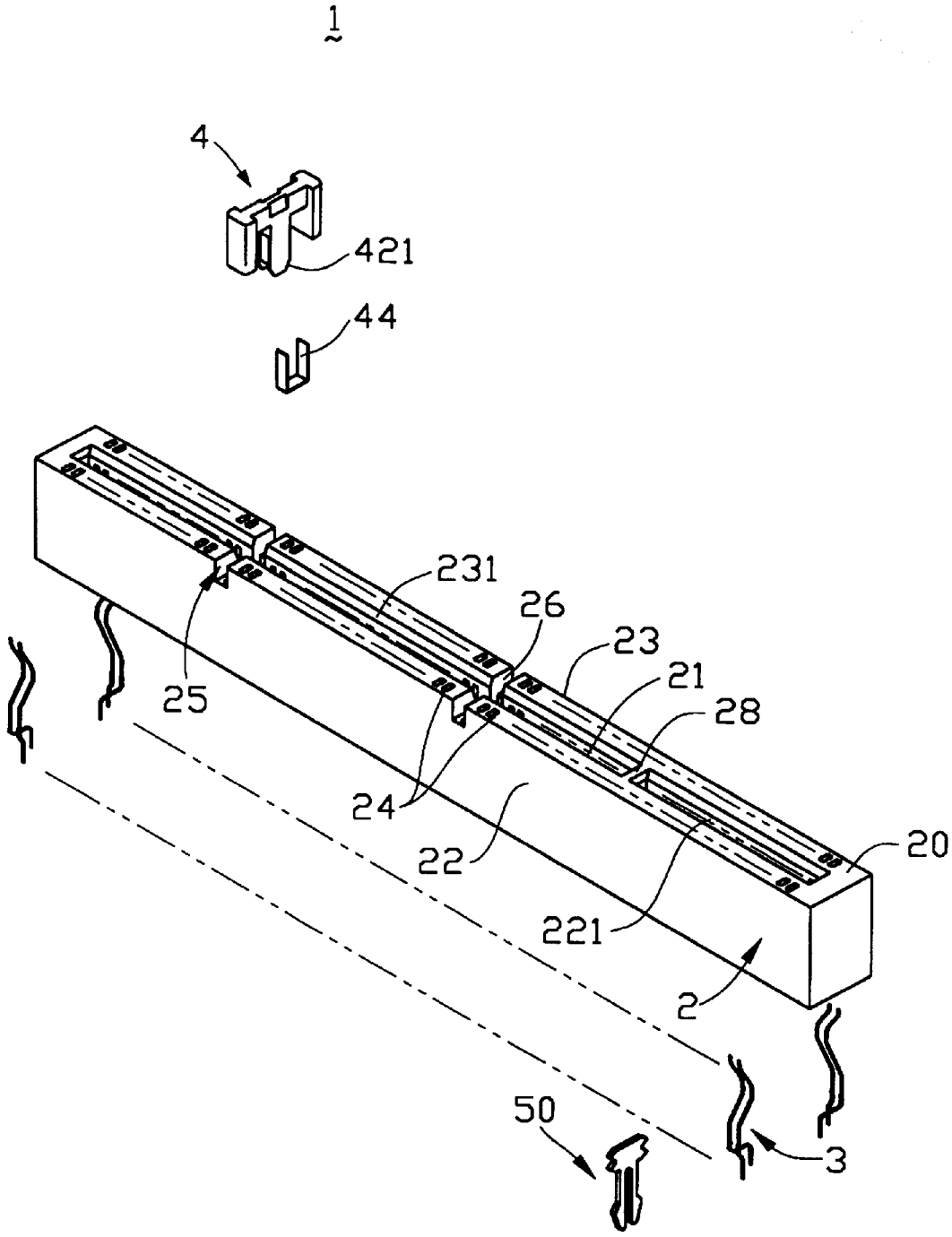
FIG. 1 is an exploded view of a card edge connector of the present invention.

Referring to FIG. 1, a card edge connector 1 in accordance with the present invention comprises an elongate housing 2 mounted on a mother board (not shown), a plurality of contacts 3 retained in the housing 2, and a switch key 4 for engaging with the housing 2 and transmitting information to the mother board. A board lock 50 is mounted on the housing 2 for positioning the card edge connector assembly 1 onto the mother board.

Figure 7A:
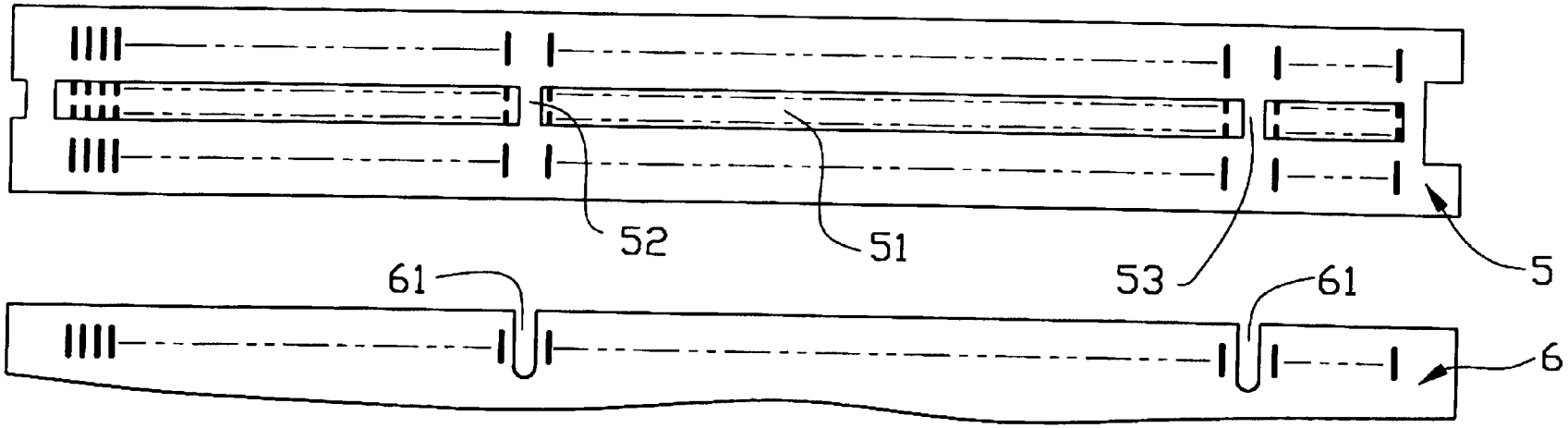
FIG. 7A (PRIOR ART)
FIG. 7A is a top view of a conventional card edge connector and a daughter board.
Figure 7B:
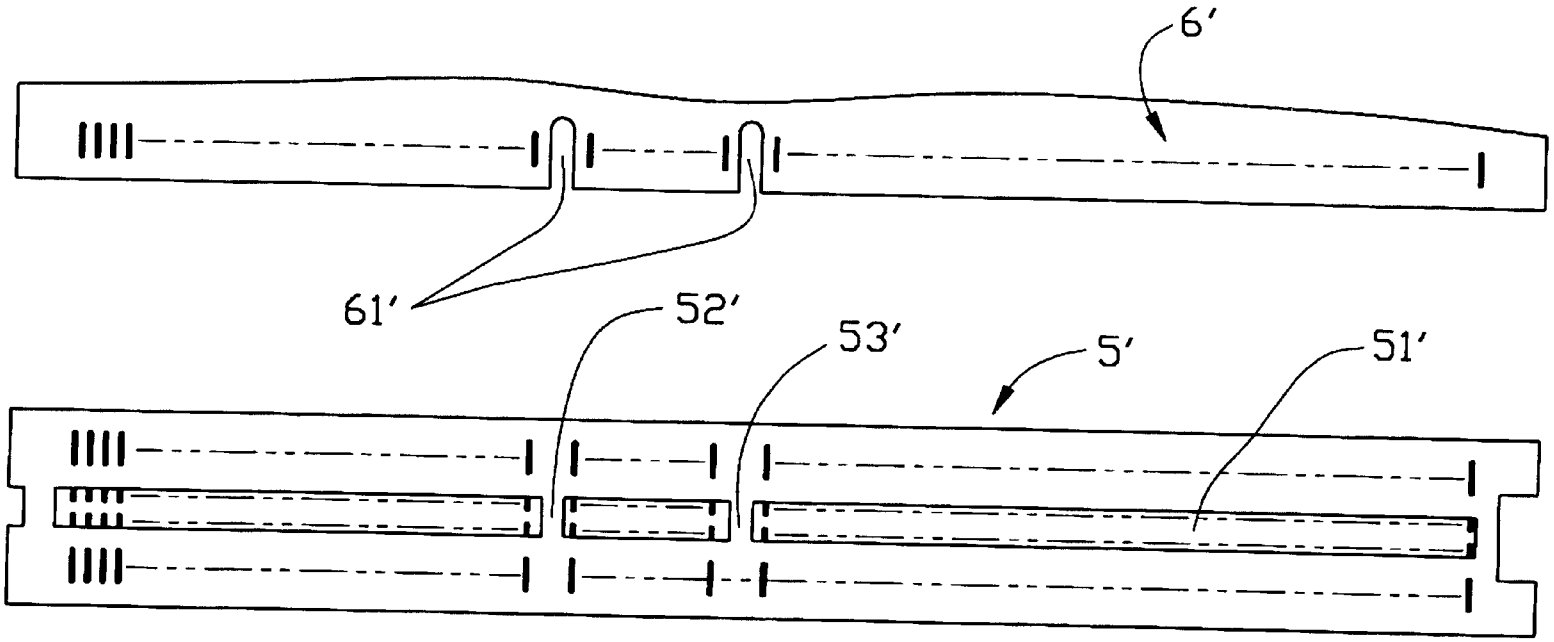
FIG. 7B (PRIOR ART)
FIG. 7B is a top view of another conventional card edge connector and a daughter board.

The housing 2 comprises an elongate slot 21 formed between opposite side walls 22, 23 thereof for receiving a daughter board 6, 6' (FIGS. 7A and 7B), a plurality of receiving passageways 24 defined in the side walls 22, 23, and a pair of cutouts 25, 26 transversely defined in an upper mating face 20 thereof. The contacts 3 are retained in the corresponding receiving passageways 24 of the housing 2.

Figure 3:
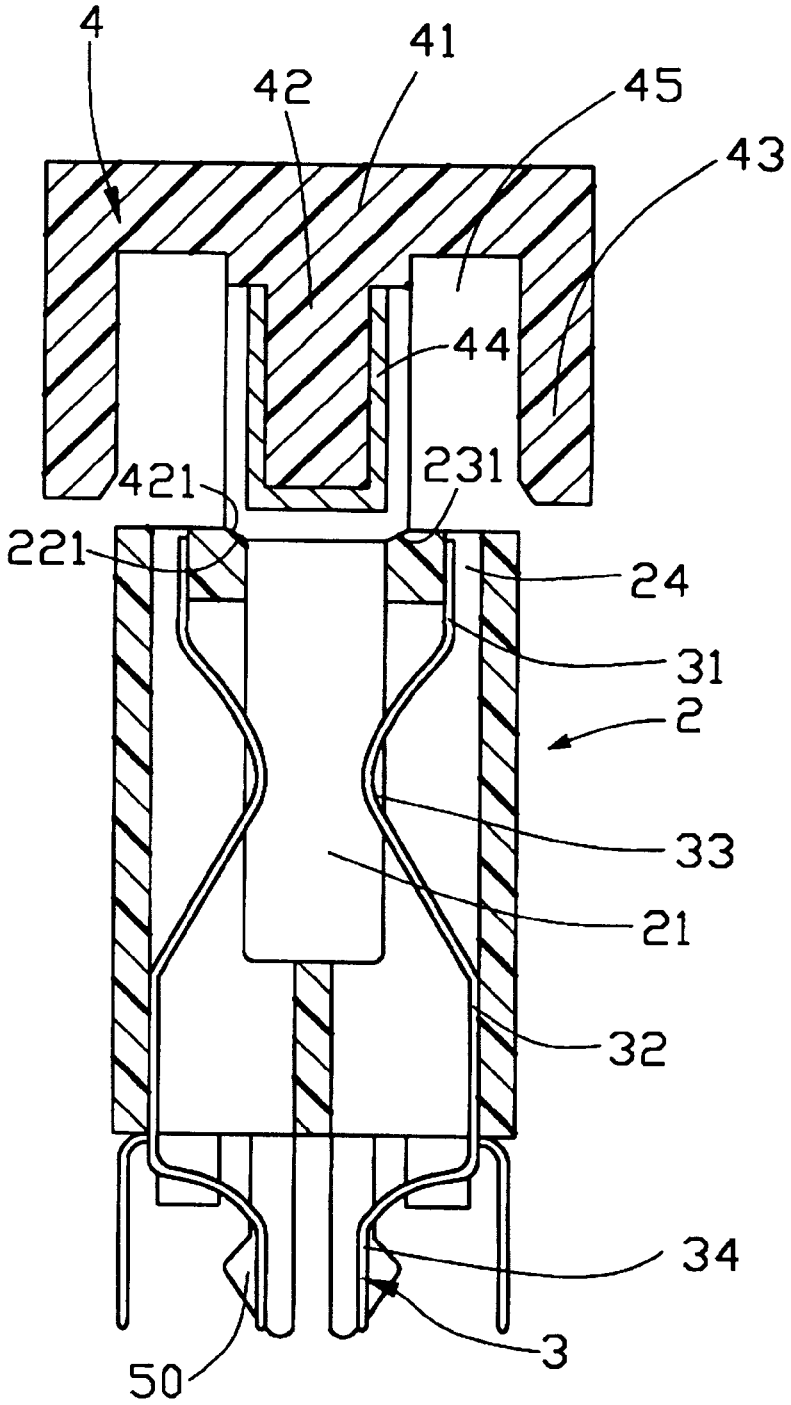
FIG. 3 is cross-sectional view taken along 3—3 line of FIG. 2.

Referring also to FIG. 3, each contact 3 comprises a abutting end 31 for abutting against an inner wall of the corresponding receiving passageway 24, a contacting section 33 extending from the abutting end 31 and partially extending into the slot 21 for electrically contacting a corresponding contacting portion of the daughter board 6, 6', an engaging section 32 on an opposite end for being retained within the passageway 24, and a connecting section 34 extending outside the passageway 24 for connecting with the mother board.

A projection 28 is formed in the slot 21 of the housing 2 between the side walls 22, 23. (Each cutout 25 (26) (cooperates with the projection 28) to provide access to inner circuitry formed in the mother board) the notches 61 of the daughter board 6 having a 3.3 v operational voltage are defined corresponding to the cutout 25 and the projection 28 of the housing 2, while the notches 61' of the daughter board 6' having a 5 v operational voltage are defined corresponding to the cutout 26 and the projection 28 of the housing 2. The circuitry representing a particular operational voltage to be activated due to the cooperation of the projection 28 and the corresponding cutout 25, 26 should be determined by practical requirements. A preferable design is provided below but other structural combinations are allowable.

Figure 2:
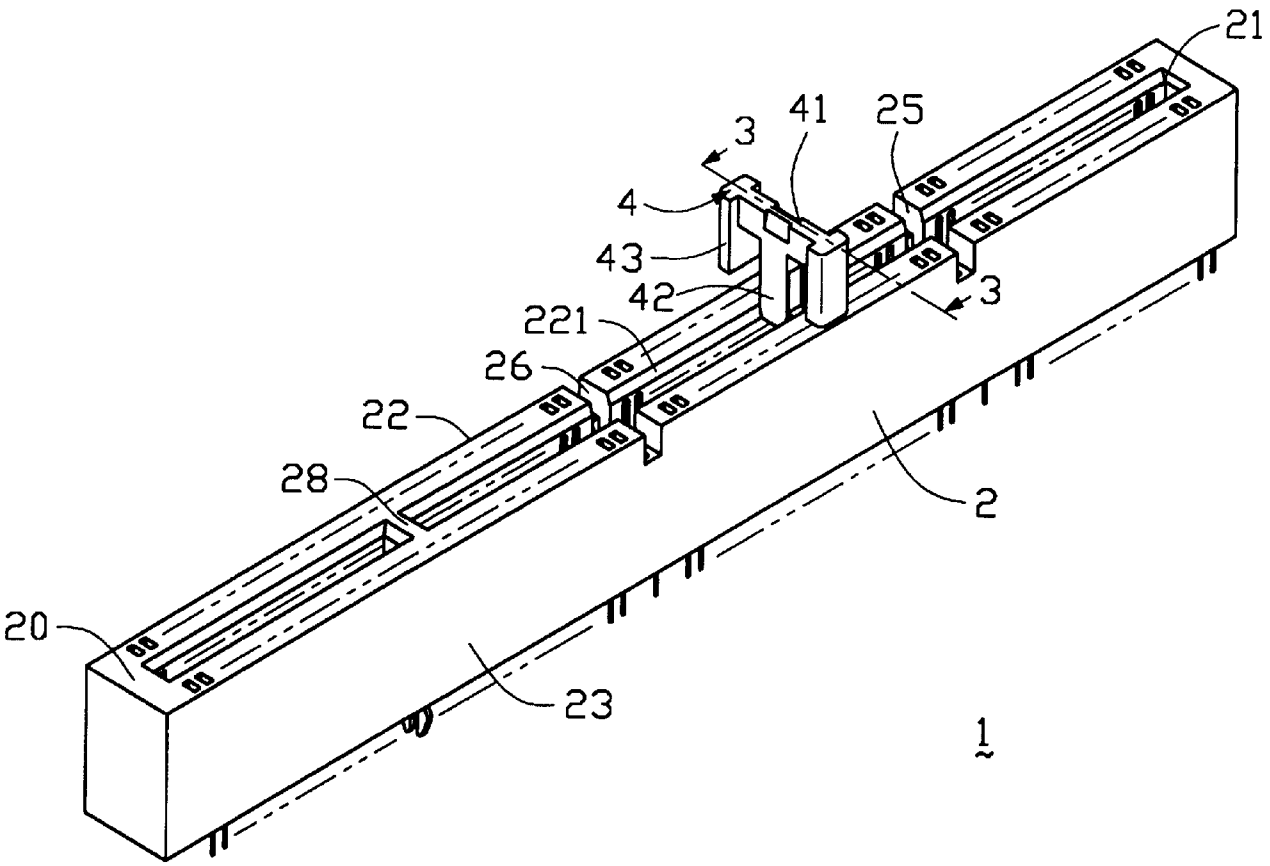
FIG. 2 is an assembled view of FIG. 1 showing a switch key being disposed between a pair of cutouts of a housing.

Referring to FIGS. 2 and 3, the switch key 4 comprises a main frame 41, a pair of cantilevered arms 43 downwardly extending from opposite ends of the main frame 41, and an engaging body 42 downwardly extending from the main frame 41 between the cantilevered arms 43. Each cantilevered arm 43 extends a length substantially equal to or longer than the engaging body 42 for abutting against outer surfaces of the side walls 22, 23 of the housing 2 thereby preventing disengagement of the switch key 4 from the slot 21. A cutout 45 is defined between each cantilevered arm 43 and the engaging body 42. The width of each cutout 45 is substantially equal to the width of the corresponding side wall 22, 23 whereby the cutouts 45 securely engage with the side walls 22, 23. A conductive membrane 44 is disposed around a periphery of the engaging body 42 for electrically engaging with the contacts 3 received in the passageways 24 below the cutout 25 (26) in which the switch key 4 is inserted.

Each cutout 25, 26 has a width equal to or slightly larger than a width of the receiving passageway 24. A pair of sloped guiding surfaces 221, 231 is formed on opposite top edges of the slot 21 of the housing 2 for guiding the switch key 4 into engagement with the corresponding cutout 25, 26. The slot 21 has a first width. The distance between top edges of the two sloped guiding surfaces 221, 231 is larger than the width of each cutout 25, 26.

A second width of the engaging body 42 of the switch key 4 is slightly larger than the first width and slightly smaller than the distance between the top edges of the sloped guiding surfaces 221, 231. Thus, the engaging body 42 of the switch key 4 can be smoothly inserted into a space defined between the sloped guiding surfaces 221, 231 of the slot 21 but will not enter into the slot 21. Moreover, a pair of inclined guiding faces 421 is formed on opposite outer edges of a free end of the engaging body 42 in compliance with the sloped guiding surfaces 221, 231 of the slot 21 of the housing 2. When the engaging body 42 of the switch key 4 is disposed into the slot 21 of the housing 2, the inclined guiding faces 421 of the engaging body 42 abut against the corresponding sloped surfaces 221, 231 of the slot 2. Thus, the switch key 4 can be smoothly moved along the slot 21 until engaging with the corresponding cutout 25 (26) due to guidance provided by the inclined guiding faces 421 of the engaging body 42 and the sloped guiding surfaces 221, 231 of the slot 21.

Figure 4:
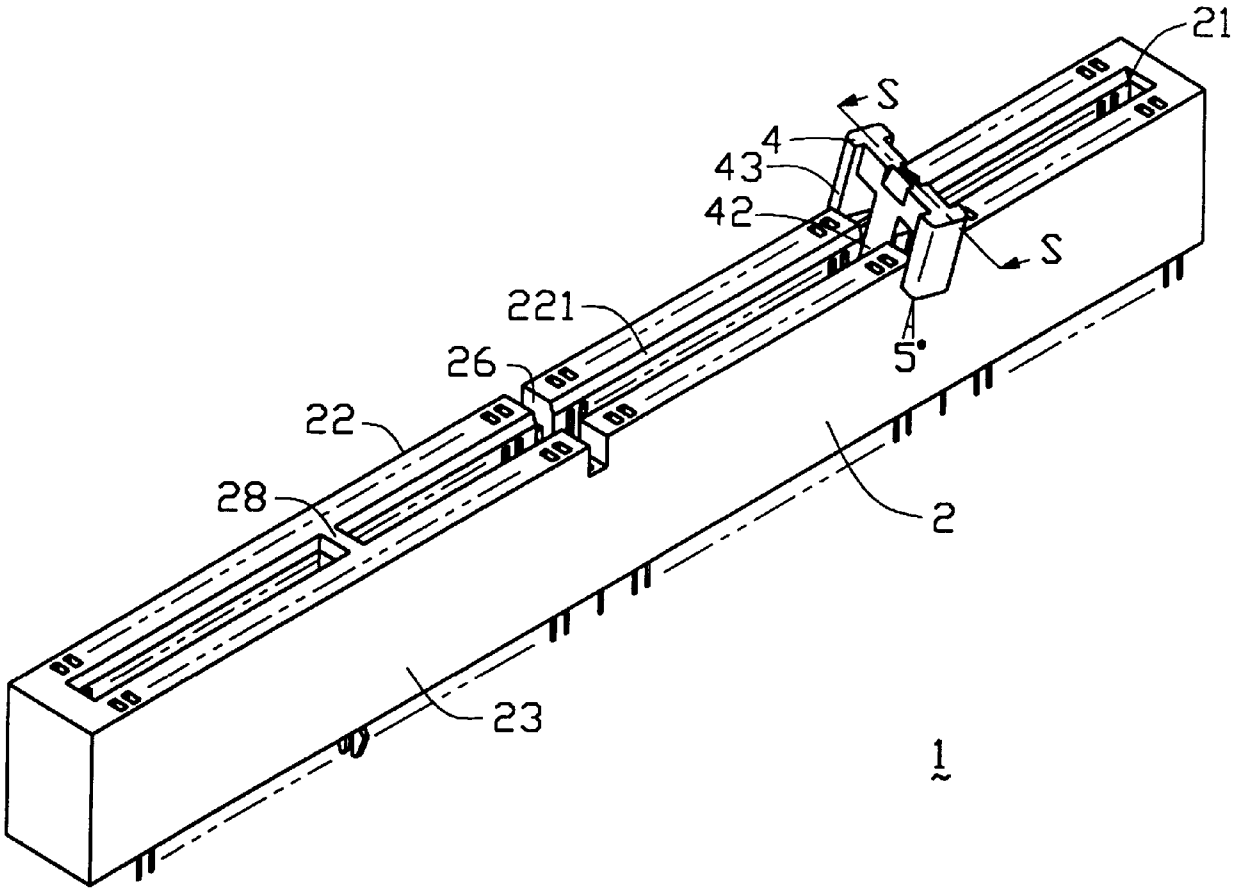
FIG. 4 is similar to FIG. 2 but showing the switch key being disposed in the cutout of the housing.
Figure 5:
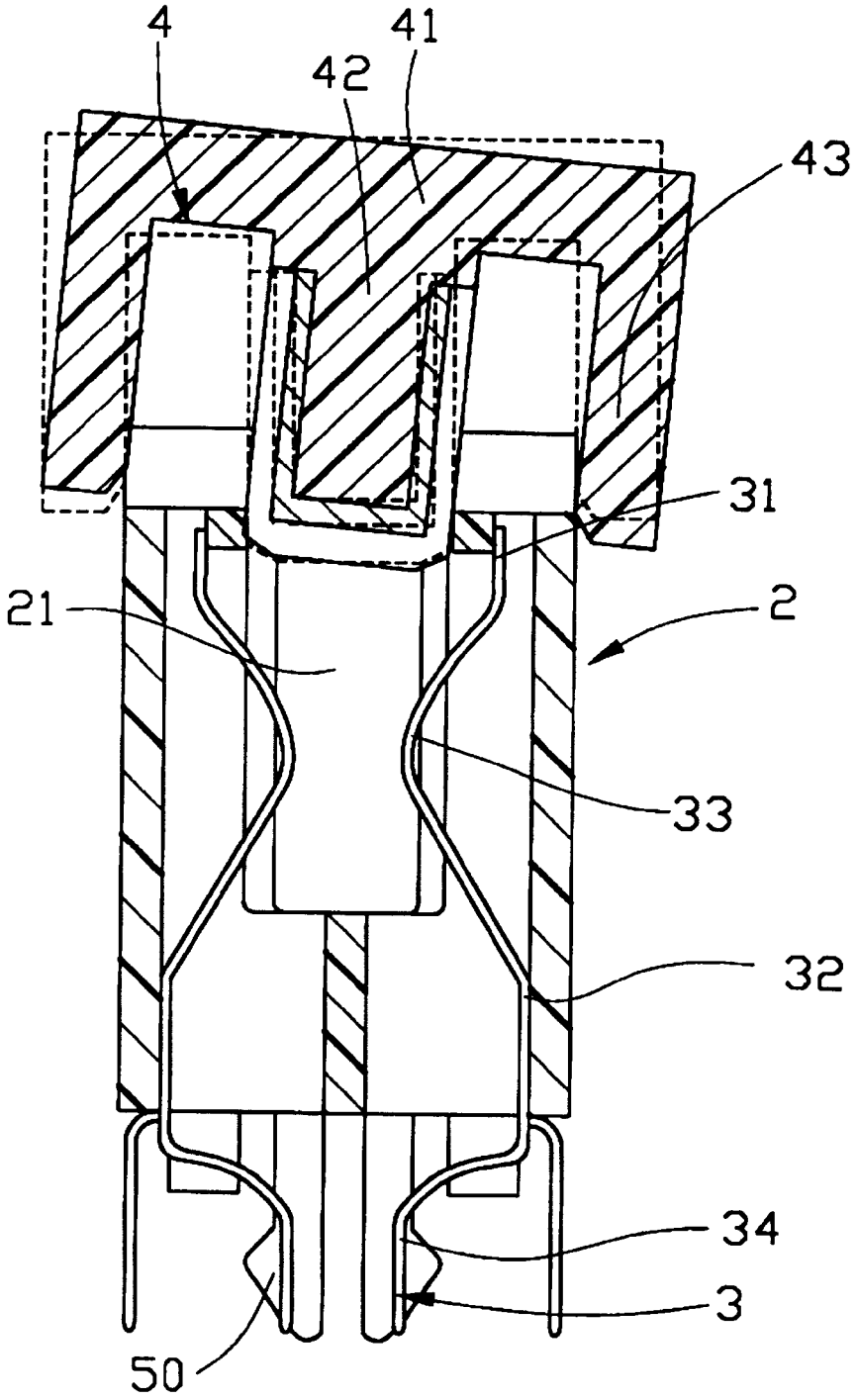
FIG. 5 is a cross-sectional view taken along line 5—5 of FIG. 4.

Referring further to FIGS. 4 and 5, when the switch key 4 is moved into the cutout 25, the switch key 4 may be slightly deflected. Since the cantilevered arms 43 of the switch key 4 are substantially identical to the engaging body 42 and the inclined guiding faces 421 of the engaging body 42 are in compliance with the sloped guiding surfaces 221, 231 of the slot 21, the switch key 4 can be properly inserted into the cutout 25 as long as a scale of the deflection of the switch key 4 is less than 5 degrees.

When the engaging body 42 of the switch key 4 is inserted into the cutout 25, the conductive membrane 44 simultaneously contacts the contacting sections 33 of the corresponding contacts 3 received in the receiving passageways 24 under the cutout 25. Thus, inner circuitry in the mother board is activated. The daughter board 6 is then inserted into the slot 21 of the housing 2, and the notches 61 simultaneously engage with the cutout 25 and the projection 28. Thus, the daughter board 6 is accepted by the mother board since the operational voltage of the daughter board 6 is distinguished due to the switch key 4 and provided by the mother board.

If another daughter board 6' having different operational voltages than the daughter board 6 is required to engage with the card edge connector 1, the switch key 4 is moved to engage within the other cutout 26 of the housing 2 thereby activating other circuitry of the mother board for providing the daughter board 6' with the proper operational voltage.

Figure 6:
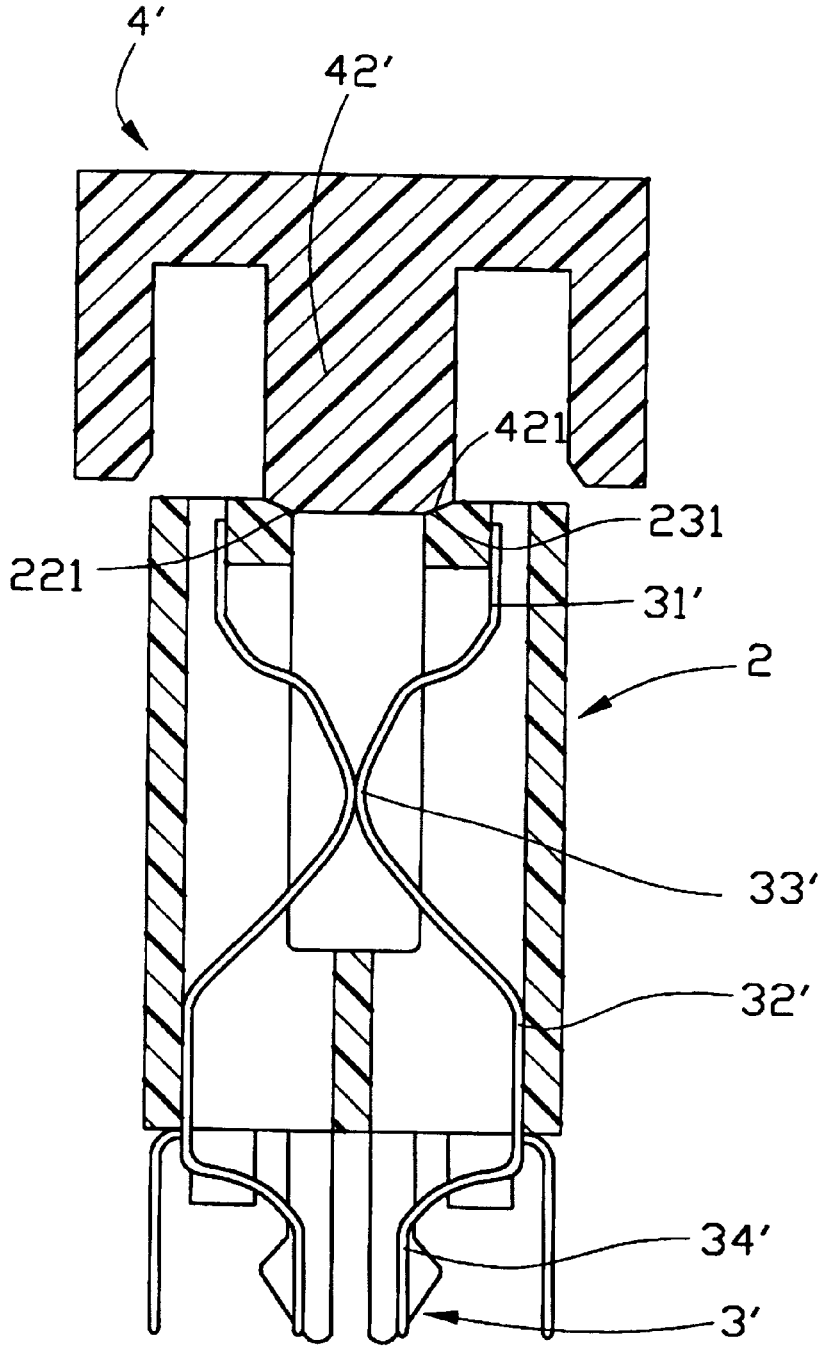
FIG. 6 is a cross-sectional view of another preferable embodiment of the present invention.

Referring to FIG. 6, a second embodiment of a card edge connector 1' in accordance with the present invention is shown. Contacting sections 33' of a pair of face-to-face contacts 3' received in the corresponding passageways 24 below the cutout 25 (26) abut against each other, thereby forming inner circuitry in the mother board. When a switch key 4' is inserted into the cutout 25 (26), an engaging body 42' thereof will separate the contacting sections 33' of the contacts 3 from each other. Thus, information is transmitted to the mother board to distinguish which type of daughter board having a certain operational voltage is inserted into the card edge connector 1. The mother board then activates the proper inner circuitry to communicate with the daughter board. The second embodiment is very similar to the first embodiment except for the distinction discussed above. Therefore, no further description is provided herein.

It should be noted that the spirit of the present invention is to provide a universal card edge connector that can transmit Information to a mother board to which the card edge connector is mounted when a daughter board having a certain operational voltage is mated with the card edge connector. The present invention fulfils such a purpose due to the provision of the switch key 4, 4'.

In the first embodiment, the switch key 4 is selectively inserted into the cutout 25 (26) thereby activating inner circuitry of the mother board due to electrical contact between the conductive membrane 44 and the contacts 3 received in the corresponding passageways 24 below the cutout 25 (26). The mother board thus accepts the daughter board 6 (6') mated with the card edge connector 1 with the notches 61 (61') engaging with the cutout 25 (26) and the projection 28 of the housing 2.

In the second embodiment, information is transmitted to the mother board by separating the engagement between the contacting sections 33' of the contacts 3' received in the corresponding passageways 24 below the cutout 25 (26) by the switch key 4'. Thus, the mother board can distinguish which type of daughter board having a certain operational voltage is mated and selectively activates the proper inner circuitry to communicate with the daughter board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector assembly for interconnecting a daughter board having a certain operational voltage with a mother board, comprising:

an elongate housing mounted on the mother board and forming an elongate slot between a pair of opposite side walls thereof for receiving the daughter board, a plurality of receiving passageways defined in each side wall for retaining contacts therein, and a pair of cutouts transversely defined in the side walls across the slot, a pair of sloped guiding surfaces being formed on top edges of the slot; and a switch key engaging with the housing for transmitting information to the mother board for distinguishing the operational voltage of the daughter board, the switch key comprising a main frame and an engaging body downwardly extending from the main frame for engaging with the housing, a pair of inclined guiding faces being formed on outer edges of the engaging body conforming in shape with the sloped guiding surfaces of the slot for smoothly guiding the switch key along the slot, a pair of cantilevered arms downwardly extending from opposite ends of the main frame for abutting against outer surfaces of the side walls of the housing thereby preventing the switch key from disengaging from the slot during inserting the switch key into the selected cutout of the housing;

wherein the width of the engaging body of the switch key is larger than the width of the slot and smaller than the distance between top edges of the sloped guiding surfaces of the slot whereby the engaging body of the switch key is partially retained in a space of the slot between the sloped guiding surfaces before the switch key is moved to engage with the selected cutout;

wherein the daughter board defines a pair of notches in an edge thereof corresponding to one of the cutouts of the housing and a projection in the slot, the switch key being inserted into the selected cutout of the housing to transmit information to the mother board whereby the mother board can distinguish the operational voltage of the daughter board inserted therein;

wherein a conductive membrane is disposed around a periphery of the engaging body of the switch key for electrically contacting the corresponding contacts received in the receiving passageways below the selected cutout thereby transmitting information to the mother board when the switch key is inserted into the selected cutout of the housing.

2. The card edge connector assembly as claimed in claim 1, wherein each cutout of the housing has a width substantially equal to the width of each receiving passageway.

3. The card edge connector assembly as claimed in claim 1, wherein each cutout of the housing has a width larger than the width of each receiving passageway.

* * * * *